US006012189A

United States Patent [19]

Dudley

[11] Patent Number: 6,012,189

[45] **Date of Patent: *Jan. 11, 2000**

[54] MULTI-PURPOSE BUNTING BAG

[76] Inventor: Sherri H. Dudley, 7890 Boothill Dr., Park City, Utah 84098

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,561

[22] Filed: Dec. 22, 1997

Related U.S. Application Data

[60] Provisional application No. 60/034,028, Dec. 23, 1996.

[51] Int. Cl.[7] ..... A47D 7/00

[52] U.S. Cl. ..... 5/655; 5/94; 5/416

[58] Field of Search ..... 5/655, 94, 113, 5/121, 416, 414, 494, 128, 413 R, 629; 297/184.13, 184.12, 184.14, 219.12, 219.1, 229, 184.11; 135/117; 224/158, 161, 409, 160

[56] References Cited

U.S. PATENT DOCUMENTS

| | | | |
|---|---|---|---|
| 598,995 | 2/1898 | Jacob | 5/413 R |
| 2,036,175 | 3/1936 | Hollander | 5/413 R |
| 3,003,164 | 10/1961 | Calvelage | 5/413 R |
| 3,962,738 | 6/1976 | Menditto . | |
| 4,183,110 | 1/1980 | Kidd et al. | 5/629 |
| 4,241,458 | 12/1980 | Lesesne . | |
| 4,698,862 | 10/1987 | Mairs | 5/413 R |
| 4,717,056 | 1/1988 | Carmichael | 224/158 |
| 4,761,032 | 8/1988 | Sanchez et al. . | |
| 4,946,221 | 8/1990 | Livingston . | |
| 4,993,090 | 2/1991 | Ranalli . | |
| 5,058,226 | 10/1991 | Crosby . | |
| 5,243,724 | 9/1993 | Barnes . | |
| 5,333,769 | 8/1994 | Skroski | 5/655 |
| 5,432,965 | 7/1995 | Espinoza . | |
| 5,437,061 | 8/1995 | Kenner . | |
| 5,437,081 | 8/1995 | Kenner | 2/69 |
| 5,522,639 | 6/1996 | Jaime | 297/184.13 |
| 5,549,354 | 8/1996 | Rosen | 297/184.13 |
| 5,551,109 | 9/1996 | Tingley et al. | 5/655 |
| 5,730,490 | 3/1998 | Mortenson | 297/184.13 |

*Primary Examiner*—Michael F. Trettel
*Assistant Examiner*—Fredrick Conley
*Attorney, Agent, or Firm*—Workman, Nydegger & Seeley

[57] ABSTRACT

A bunting bag, particularly well suited for use with children and child carriers, has a top portion detachably coupled to a bottom portion so that the top portion may be completely removed from the bottom portion. The bottom portion is configured or shaped to nest or mate in the child carrier without folds or substantial overhangs. The bottom portion has a head, back, seat, leg, left and right portions and surface area. The top portion has a head, body, and leg portion and preferably covers the bottom portion. The top portion has a surface area less than the surface area of the bottom portion. A first and second two-way zipper couples the bottom end and left and right side of the top and bottom portions. The zippers allow the head portion to fold over the body portion to expose the child's head. In addition, the head and body portions may fold over the leg portion. Furthermore, the leg portion may fold up over the body portion to expose the child's legs. The bunting bag may also be sized and configured for use with adults and seats.

26 Claims, 4 Drawing Sheets

MULTI-PURPOSE BUNTING BAG

This application claims the benefit of U.S. Provisional Application No. 60/034,028, filed Dec. 23, 1996.

BACKGROUND OF THE INVENTION

1. Field of the Invention

The present invention relates to a multi-purpose bunting bag, particularly well suited for use with a child and a child carrier or the like. More particularly, the present invention relates to a bunting bag having a generally shaped bottom portion configured for nesting or mating with a carrier or seat, a top portion detachably coupled to the bottom portion for forming a bag and selectively covering portions of a person, and a pair of two-way zippers each coupling one side and a portion of a bottom end of the bag so that any side or bottom of the bag may be selectively opened while the rest of the bag is closed.

2. Prior Art

There are many situations which require a person to sit for substantial periods of time. For example, infants often spend most of their first six to nine months sitting in a child carrier. The term child carrier is meant to include anything adapted to hold a child, including for example, child safety seats, child carriers, strollers, joggers, high chairs, "bouncy" seats, bike seats, back packs configured to hold a child, etc. Older children, as well, spend significant periods of time in carriers, such as child seats when driving.

As another example, older people or people with disabilities, may spend all day sitting in a seat, including for example, wheel chairs, arm chairs, reclining chairs, tilting beds, etc. Other situations which may require people to sit for long periods of time include sporting events, parades, office work, fishing, driving, etc. In many of these situations, the act of sitting may be made uncomfortable either due to the seat conditions or the special physical requirements of the person, such as the inability to shift positions.

In addition, many situations in which people sit for extended periods may also be relatively cold. For example, a child, elderly person, disabled person, or others, may feel cold at "room temperature" due to inactivity. As another example, weather conditions may make certain sitting situations cold, such as, outdoor football games, ice fishing, jogging with a child in a jogger, etc.

In addition, some situations may require access to the seated person. For example, access is typically required to infants and children to change diapers. Similarly, access in sometimes necessary for the elderly or disabled to check medical devices or drain tubes. In addition, some situations may require periodic movement from the seat by the seated person. For example, a sports fan at a ball game may need to stand to cheer, or at least see the event during critical moments. As another example, an ice fisher may need to stand to work with the line.

Furthermore, some situations involve frequent or significant temperature changes. For example, an infant in a child carrier may be transported between the cold outdoors and the warm shopping centers and cars.

Numerous devices have been developed to address one or some combination of these problems. For example, U.S. Pat. No. 4,761,032, issued Aug. 2, 1988, to Sanchez et al. discloses an infant seat cover with a hood and rollable blanket for covering an infant seat. One disadvantage with this seat cover is that portions of the cover and the blanket hang out of and over the seat where they pose potential safety hazards in some situations. For example, with joggers and strollers the overhanging portions may interfere or be caught in moving parts, such as adjustable handles and wheels. Another disadvantage with this seat cover is that the blanket is integrally attached to the cover so that the blanket may not be removed from the seat cover if desired.

As further examples, U.S. Pat. No. 4,241,458, issued Dec. 30, 1980, to Lesesne and U.S. Pat. No. 5,437,061, issued Aug. 1, 1995, to Kenner, both disclose bag-like devices having openings in the tops and bottoms and a central zipper extending from the top openings. One disadvantage of these devices is that the bag-like configuration is bulky, leaving portions of the bags to bunch up and make sitting uncomfortable. Another disadvantage is that the single, central zipper divides the top portion of the bag into two halves which must be either bunched up in the seat, compromising comfort, or overhang the seat, compromising safety, in order to uncover the child in hot conditions. Another disadvantage is that portions of the bulky bag can overhand the seat and pose safety hazards. This is especially true of the Kenner device, which is designed to surround or enclosed the seat as well.

As further examples, U.S. Pat. No. 3,962,738, issued Jun. 15, 1976, to Mendito, U.S. Pat. No. 5,243,724, issued Sep. 14, 1993, to Barnes, and U.S. Pat. No. 5,058,226, issued Oct. 22, 1991, to Crosby, all disclose blanket devices with a pocket for receiving the legs of an infant. One disadvantage to these devices is that the blanket must be wrapped around the infant and causes folds or bunches that are uncomfortable. Another disadvantage is that the pockets divide into two portions for receiving each leg, thus making leg movement difficult and constricting. Another disadvantage is that the excess portions of the blanket hang over the seat and pose a safety hazard.

Therefore, it would be advantageous to develop a comfortable bunting bag with room for movement, but without uncomfortable bulges or folds. It would also be advantageous to develop a bunting bag configured or shaped to nest or mate with a carrier or seat. It would also be advantageous to develop a bunting bag for selectively covering a person to provide warmth when cold and for selectively opening to expose the person when excessively hot. It would also be advantageous to develop a bunting bag that selectively opens certain sections to provide access to selected areas of the person. It would also be advantageous to develop a bunting bag with openings positioned to allow a person to use their hands outside of the bag or to allow the person to move when necessary. In addition, it would be advantageous to develop a bunting bag that is substantially laterally contained within a seat so that parts of the bag do not overhang the seat and interfere with the seat or other activities posing safety hazards.

OBJECTS AND SUMMARY OF THE INVENTION

It is an object of one embodiment of the present invention to provide a bunting bag that is comfortable, with room for feet movement and without folding or bunching.

It is another object of one embodiment of the present invention to provide a bunting bag that is configured or shaped to nest within or mate with a seat or carrier.

It is yet another object of one embodiment of the present invention to provide a bunting bag with an adjustable covering for covering only desired portions of a person.

It is yet another object of one embodiment of the present invention to provide a bunting bag with openings for safety or restraining straps.

It is yet another object of one embodiment of the present invention to provide a bunting bag that does not interfere with safety or restraining straps.

It is yet another object of one embodiment of the present invention to provide a bunting bag with a detachable top portion to expose the person in hot conditions without bunching or overhanging.

It is yet another object of one embodiment of the present invention to provide a bunting bag with openings for a person's hand and/or feet.

It is yet another object of one embodiment of the present invention to provide a bunting bag with a soft interior and a rugged or wear resistant exterior.

It is yet another object of one embodiment of the present invention to provide a bunting bag that selectively opens the sides or bottom to provide access to the person.

It is a further object of one embodiment of the present invention to provide a bunting bag that is substantially laterally contained within a seat or carrier so that portions do not overhang and cause safety hazards or other undesirable interference.

These and other objects and advantages of the present invention are realized in a bunting bag having a separate top portion detachably coupled to a configured bottom portion. The bottom portion is configured or shaped to nest within or mate is with a child carrier. The shaped bottom portion prevents folds or bunching which cause discomfort. The bottom portion is flexible and sized to fit within common child carriers without substantially laterally protruding or hanging over the carrier. The contained bottom portion prevents the bunting bag from interfering with the operation of the carrier or its surroundings. The bottom portion has a surface area and forms a containment area for holding a person.

The top portion is preferably capable of completely covering the bottom portion. In addition, the top portion may selectively cover portions of the bottom portion or child. A head portion may be folded over a body portion to expose the child's head. The head and body portions may be folded over a leg portion to further expose the child. In addition, the leg portion may be folded up over the body portion to provide access to the child's legs or to change a diaper. The top portion is also flexible and sized to fit within common child carriers without substantially laterally protruding or hanging over the carrier. The top portion has a surface area less than the surface area of the bottom portion.

Openings may be formed in the top or bottom portions. Openings in the bottom portion receive safety or restraining straps. Openings in the top portion provide hand or arm access.

Both top and bottom portions have a soft inner surface or layer. In addition, both preferably have a rugged outer surface or layer. The outer layer or surface may be waterproof.

The top portion is detachably coupled to the bottom portion. The detachable top portion allows the top portion to be removed to provide access or for warmer conditions. Because the top portion is removable, it does not hang over the side of the carrier and pose a safety hazard. In addition, it does not bunch up around the child and cause discomfort.

The top portion is coupled to the bottom portion by first and second two-way zippers disposed about a portion of the periphery of both portions. The first zipper is disposed about left side and a portion of the bottom end of the top and bottom portions while the second zipper is disposed about right side and a portion of the bottom end. The zippers provide an opening in the bottom of the bag. The two zippers allow either side or the bottom to be opened while the others remain closed.

The bunting bag may be sized and configured for use with adults and other types of chairs.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
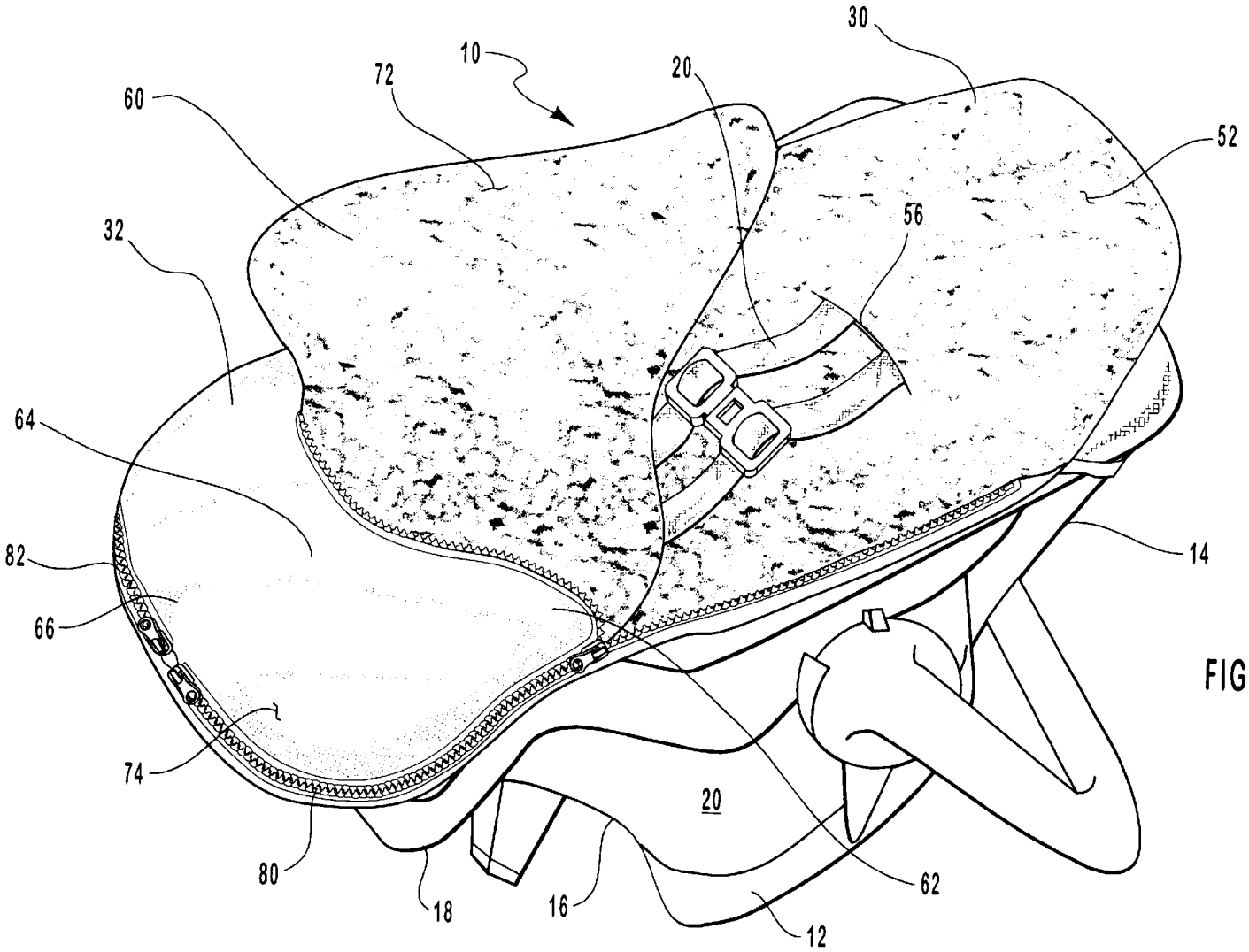
FIG. 1 is a perspective view of a preferred embodiment of a bunting bag of the present invention shown being used with a child carrier.
Figure 2:
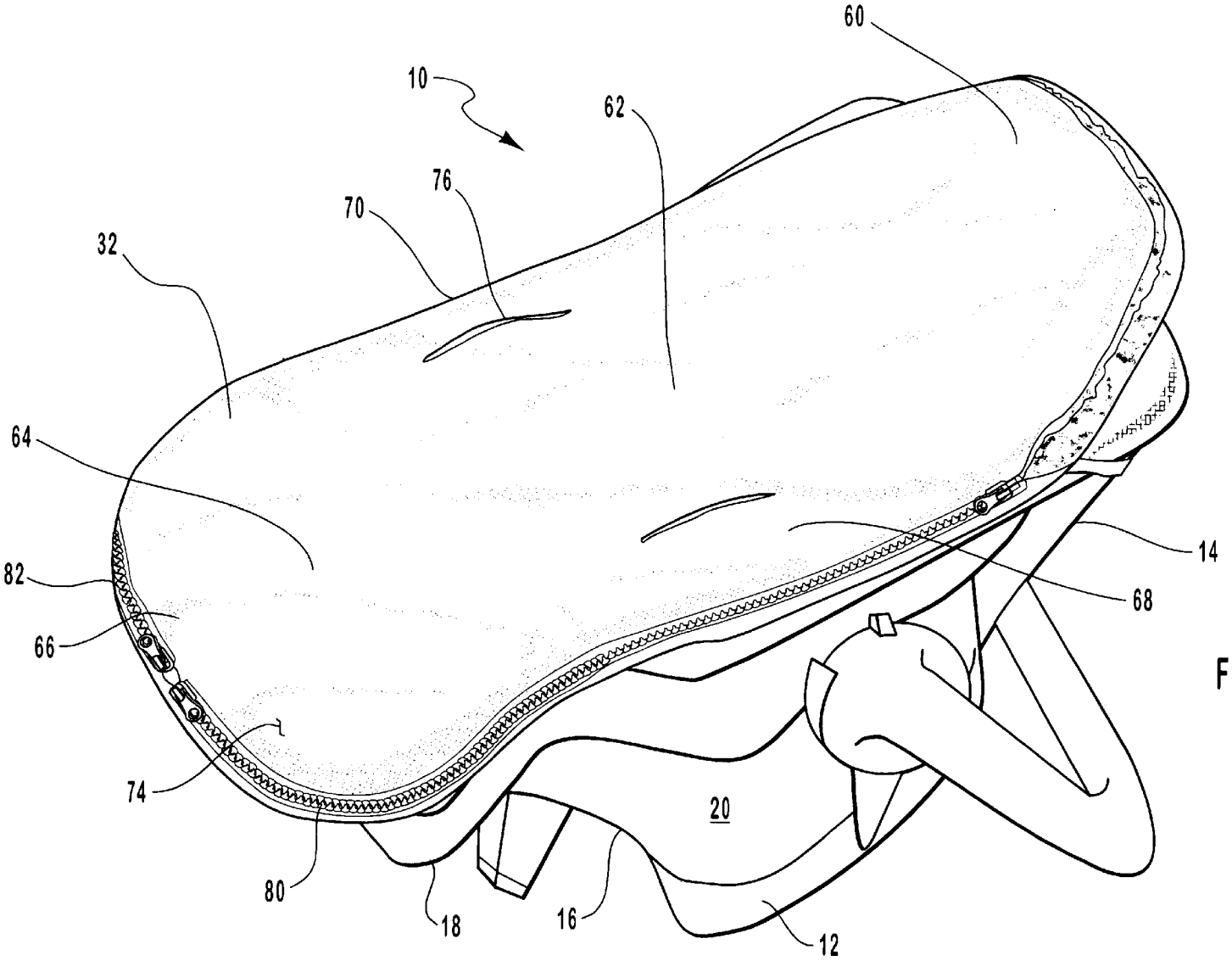
FIG. 2 is a perspective view of a preferred embodiment of the bunting bag of the present invention shown being used with a child carrier.
Figure 3:
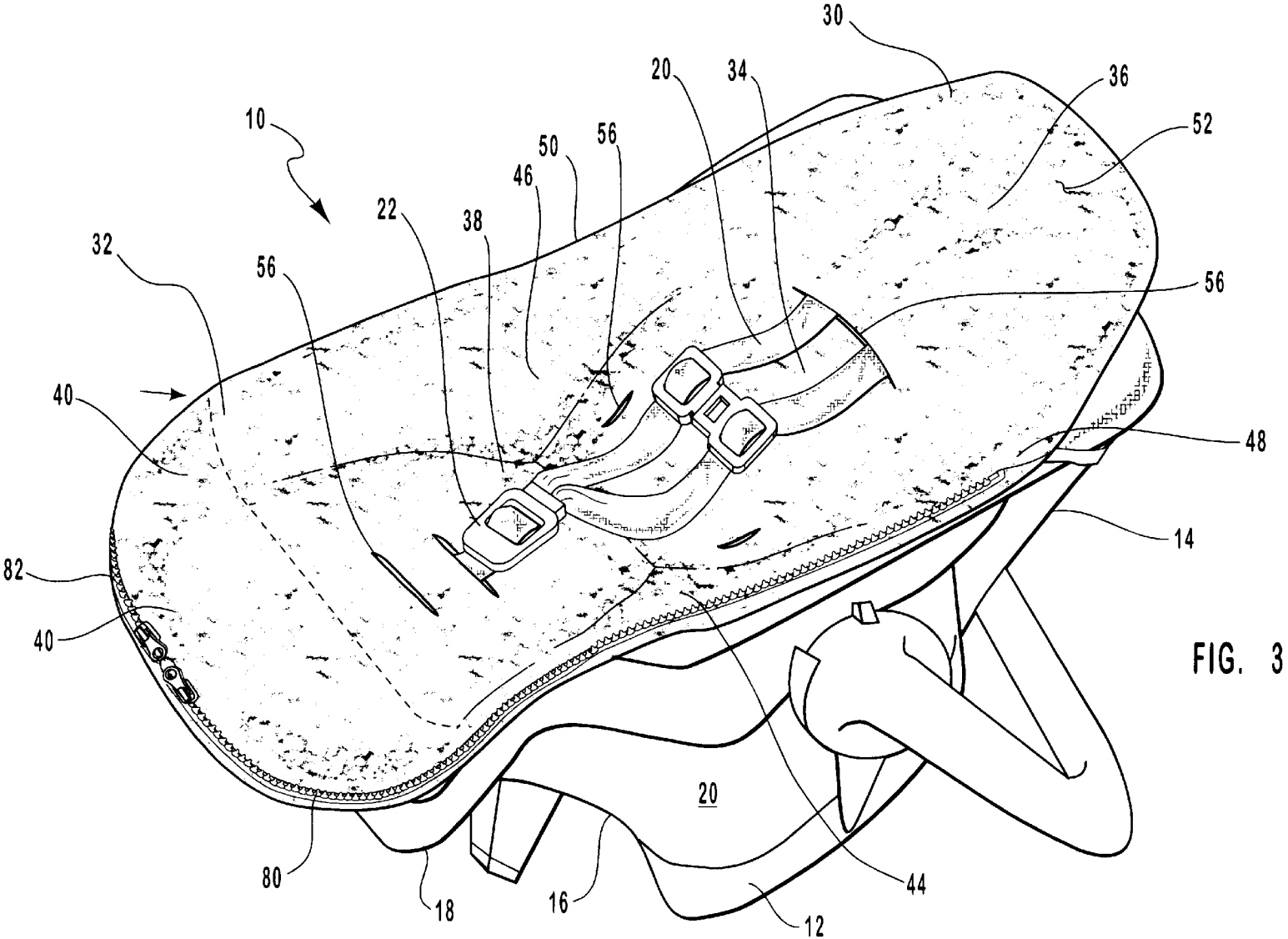
FIG. 3 is a perspective view of a bottom portion of a preferred embodiment of the bunting bag of the present invention shown with a top portion removed and being used with a child carrier.

As illustrated in FIGS. 1–3, a preferred embodiment of a bunting bag 10 of the present invention is shown being used with a child carrier 12. The bunting bag shown in the figures is configured for use with an infant or child and a child carrier. It is of course understood that the bunting bag of the present invention is not limited to use with children and child carriers, but may be sized for use with older children and adults and may be configured for use with other types of seats.

The term "child carrier" refers to devices adapted for holding children and/or infants and includes, for example, child safety seats, child carriers, strollers, joggers, high chairs, "bouncy" seats, bike seats, back packs configured to hold a child, swings, and the like. Furthermore, the term "seat" refers to devices adapted for sitting and includes, for example, chairs, recliners, couches, benches, wheel chairs, adjustable/reclining beds, and the like. The term "seat" also refers to child carriers.

The child carrier 12, a combination carrier and safety car seat as shown in the drawings, has a back portion 14, a seat portion 16, a leg portion 18, a left side portion 20, and a right side portion (not shown). The back portion 14 and seat portion 16 form an inclined angle with respect to each other. The seat portion 16 and leg portion 18 also form an angle with respect to each other. The left and right side portions 20 extend between the back and seat portions 14 and 16B extend upwardly. The portions of the carrier 12 form a general containment area for holding a child. Child carriers, as referred to above, typically have these general characteristics. Similarly, a seat typically has a back portion and a seat portion forming an angle with respect to the back portion. The seat may or may not have sides and a leg portion, and in some instances may not have a back portion.

In addition, the child seat 12 has safety straps 22 extending from the back portion 14 to a safety harness buckle 24 secured to the seat portion 16, as shown in FIG. 3, and configured for passing over both shoulders and between the legs of a seated infant. Again, child carriers typically have some form of safety or restraining straps. Such straps may be shoulder straps as described above, or may be other types including lap straps or five point straps. In addition, some types of seats, such as wheel chairs, may include similar safety or restraining straps.

The bunting bag 10 advantageously has a bottom portion or shell 30 and a separate top portion or shell 32, as shown in FIG. 1. The top portion 32 is advantageously detachably coupled to the bottom portion 30 as discussed more fully below. Thus, the top portion 32 of the bunting bag 10 may be removed from the bottom portion 30 to expose the child or person when required or desired.

One advantage of having a removable top portion is to expose the child or person in warmer conditions, such as when indoors or in a car. Another advantage of having a removable top portion is to provide access to the child or person, such as to check on their condition, change a diaper, apply and remove medical devices, and the like.

Another advantage of having a removable top portion is to provide access to the safety restrains, such as when strapping in a child. In addition, the removable top portion allows the safety straps to be placed over the child, rather than the top portion, as intended by the designers of the safety straps.

Another advantage of the removable top portion is that it may be completely removed from the bag and the carrier. Thus, it does not bunch up around the child in the carrier, causing discomfort. In addition, it does not hang over the side of the carrier and interfere with parts of the carrier, such as adjustable handles or portions that lock into modular car safety seats. Furthermore, the top portion does not hang over the carrier and pose a safety hazard, such as by getting caught in the wheels of a jogger or catching and pulling over a store display.

Figure 5:
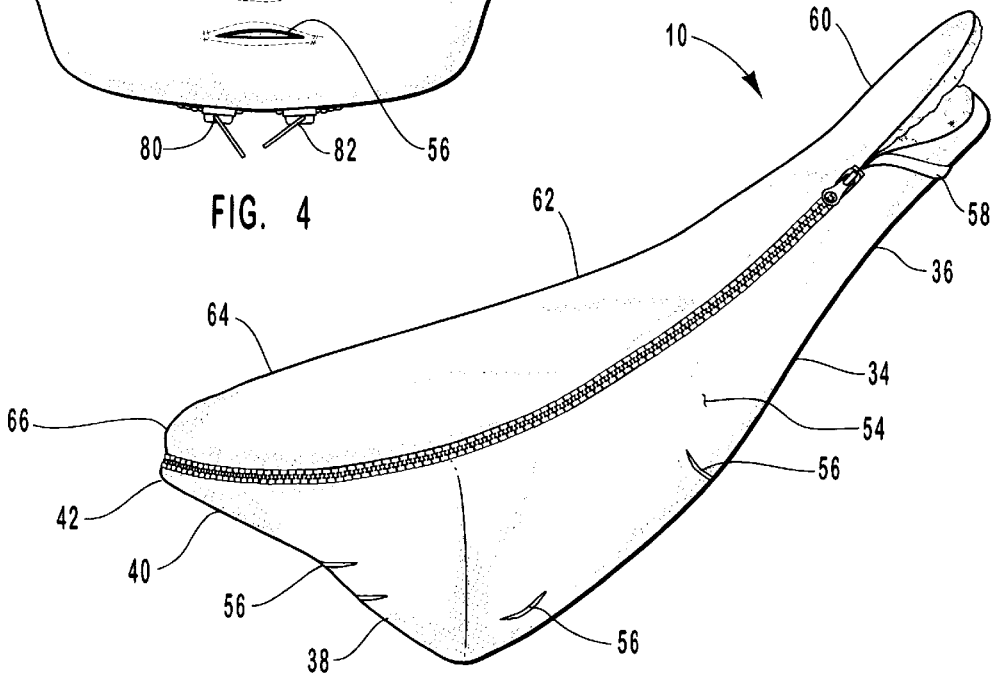
FIG. 5 is a side view of a preferred embodiment of the bunting bag of the present invention.

Referring to FIGS. 3 and 5, the bottom portion or shell 30 is advantageously configured, contoured, or shaped to nest within or mate with the carrier 12 without substantial bunching or folding. The bottom portion 30 has a back portion 34, a head portion 36 extending from the back portion, a seat portion 38 extending from the back portion, and a leg portion 40 extending from the seat portion. Similarly to the child seat, the back and seat portions 34 and 38 of the bottom portion 30 form an inclined angle with respect to each other. The seat and leg portions 38 and 40 may also form an angle with respect to each other.

The leg portion 40 has a bottom end 42 forming the end of the bunting bag 10. The leg portion 40 provides a substantially wide area for leg movement of the child. One advantage of having a wide leg portion is comfort. The wide leg portion does not constrict movement.

Referring to FIG. 3, the bottom portion 30 also has a left side portion 44 and a right side portion 46. The left and right portions 44 and 46 extend between the back and seat portions 34 and 38 and extend upwardly. The bottom portion 30 has a left side 48 and a right side 50 extending along the leg, seat, and back portions 40, 38, and 34. The back, head, seat, leg, left and right side portions form a containment area for holding the child and define a surface area of the bottom portion. One advantage of the shaped or configured bottom portion 30 is that the bottom portion nests with or mates with the carrier 12. Thus, the bottom portion creates few, if any, folds or bunches which cause discomfort. In this sense, the bottom portion or shell is merely an extension of the carrier. In addition, because the bottom portion nests within the carrier it may be left in the carrier when not in use, the mating nature of the bottom portion helping to retain it in the carrier in an aesthetic manner.

The bottom portion 30 is also flexible. Thus, the bottom portion 30 may conform to different styles and shapes of child carriers. In addition, the flexible bottom portion provides a cushion for comfort.

The bottom portion 30 is advantageously sized to generally fit within the carrier 12. Because the bottom portion 30 is also preferably sized and configured for use with a number of differently styled child seats, a perimeter of the bottom portion 30 may remain within the confines of the carrier, rest on the sides 20 of the carrier, or extend slightly over the sides of the carrier. The bottom portion, however, preferably does not hang over the sides or project laterally a significant distance to interfere with the carrier or other objects.

One advantage of the fitted bottom portion is that it does not over hang or protrude from the carrier and interfere with portions of the carrier, such as adjustable handles or fittings between modular safety seats. In addition, it does not pose safety hazards, such as by catching in stroller wheels or hooking onto and overturning displays.

Figure 4:
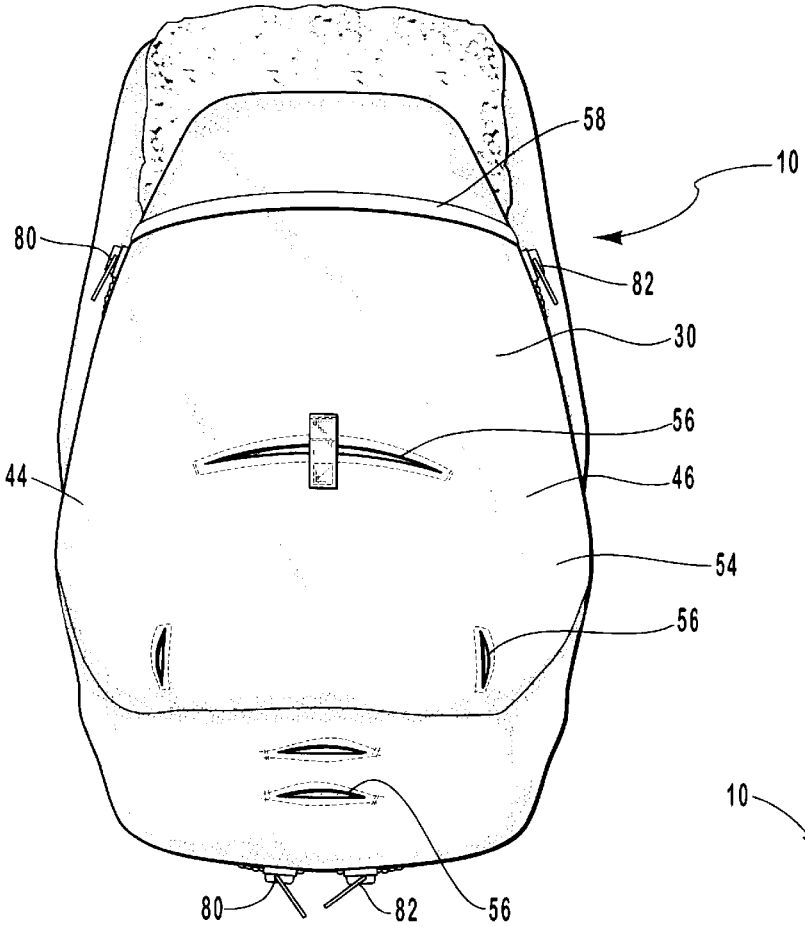
FIG. 4 is a bottom view of a preferred embodiment of the bunting bag of the present invention.

The bottom portion 30 has a soft inner layer or surface 52, as shown in FIGS. 1 and 3. The soft inner layer 52 contacts the child and is preferably made of a soft and breathable material. The material may be fleece, sheepskin, faux sheepskin, or the like. The bottom portion 30 also has an outer layer or surface 54, as shown in FIGS. 4 and 5. The outer layer 54 is preferably made of a rugged and wearable material. The outer layer 54 may also be made of a weatherproof or waterproof material. The material may be a synthetic or cotton or the like.

Referring to FIGS. 3 and 4, a plurality of holes 56 are formed in the bottom portion to provide for safety or restraining straps. A support strap 58 may extend between the left and right sides 40 and 42 and fit around the back of the carrier 12 to help support the back portion 34 of the bottom portion 30, as shown in FIG. 4.

Referring to FIGS. 2 and 5, the top portion 32 advantageously covers substantially all of the bottom portion 30. Thus, the entire child may be covered by the top portion, including the child's head. One advantage of completely covering the child is that the child's face may be kept warm or may be protected from the wind or rain.

Alternatively, the top portion 32 may only cover a portion of the bottom portion 30, such as the leg, seat, and back portions 40, 38, and 34. Thus, the head portion 36 is always uncovered.

The top portion 32 preferably has a head portion 60, a body portion 62, and a leg portion 64. The top portion 32 also has a bottom end 66, a left side 68, and a right side 70, as shown in FIG. 2. The top head, body, and leg portions define a surface area of the top portions which is less than the surface area of the bottom portion. Thus, the top portion may remain generally flat while the bottom portion is contained. One advantage of having a top portion with a smaller surface area is that it prevents folds or bunching that is uncomfortable.

The leg portion 64 of the top portion 32 generally covers the child's legs or the leg and seat portions 40 and 38 of the bottom portion 30. The body portion 62 of the top portion 32 generally covers the child's body or the seat and back portions 38 and 34 of the bottom portion 30. The head portion 60 of the top portion 32 covers the child's head or the head portion 36 of the bottom portion 30. Alternatively, the top portion 32 may not have a head portion 60.

The top portion 32 may be disposed to entirely cover the bottom portion 30 as described above, and as shown in FIGS. 2 and 5. In addition, the top portion 32 is flexible and advantageously may selectively cover portions of the bottom portion 30, as shown in FIG. 1. For example, the head portion 60 may be folded over the body portion 62 in order to expose the child's head, as shown in FIG. 1. In addition, the head and body portions 60 and 62 may be folded over the leg portion 64 to further expose the child's head and body.

Furthermore, the leg portion 64 advantageously may be folded up over the body portion 62 to expose the child's legs. Thus, the bottom ends 42 and 66 of the bottom and top portions 30 and 32 may be opened. One advantage of opening the bottom ends 42 and 66 and folding the leg portion 64 over the body portion 62 is to permit the child's diaper to be checked or changed.

Referring to FIG. 1, the top portion 32 also has a soft inner layer or surface 72 for contacting the child. The inner layer 72 of the top portion 32 may be made of a material similar to that of the inner layer 52 of the bottom portion 30. The top portion 32 also has an outer layer or surface 74. The outer layer 74 of the top portion 32 may be made of a material similar to that of the outer layer 54 of the bottom portion 30.

The top portion 32 may also have openings 76 formed therein. The openings 76 may be hand or arm openings for allowing a person's hands or arms to extend out of the device 10, in FIG. 2. One advantage of the openings is that a child may play with toy. Another advantage of the openings is that a person may extend their hands or arms out of the openings to hold a book and thus use the device 10 while reading.

Referring to FIGS. 1, 2 and 4, the top portion 32 is detachably coupled to the bottom portion 30 by first and second two-way zippers 80 and 82. The zippers 80 and 82 are disposed about a portion of a perifery of the bottom and top portions 30 and 32. The first zipper 80 is preferably disposed about the left sides 48 and 68 and a portion of the bottom ends 42 and 66 of the bottom and top portions 30 and 32. The second zipper 82 is preferably disposed about the right sides 50 and 70 and a portion of the bottom ends 42 and 66 of the bottom and top portions 30 and 32.

With both zippers 80 and 82 completely engaged, the bottom and top portions 30 and 32 form a generally enclosed bag, as shown in FIGS. 2 and 5. The zippers 80 and 82 may be selectively undone or opened to detach the top portion 32 from the lower portion 30 and expose the child. For example, the first zipper 80 may be totally or partially undone, as shown in FIG. 1. In addition, both zippers 80 and 82 may be partially undone so that the head and/or body portions 60 and 62 of the top portion 32 may be folded over as described above.

Furthermore, the zippers 80 and 82 advantageously may be undone from the bottom ends 42 and 66 because the zippers are a two-way type. The two-way zippers allow the device 10 to be open from the bottom to form an opening in the bottom of the device. Thus, the child's feet may be exposed, or a person's feet may protrude from the device 10 so that the person may stand and move about as required. For example, a person at a foot ball game may open the device 8 from the bottom and extend their feet in order to stand and cheer. Another advantage of the two-way zippers and open bottom is that the zippers may be undone and the leg portion of the top portion folded up so that the child's diaper may be changed without having to uncover the rest of the child.

The zippers 80 and 82 may be completely undone to detach the top portion from the bottom portion. In addition, either zipper may be completely undone so that the top portion may be folded to one side. The two-way zippers allow the top portion to be selectively coupled and disposed over the bottom portion to configure the device as desired.

The two-way zippers are one example of a fastening means for detachably coupling the top portion to the bottom portion. It is of course understood that many different types of fasteners may be used, including for example, snap type fasteners, ties, buttons, hook-and-loop type fasteners, cord threaded through grommets or eyelets, etc. It is also understood that a single zipper may be used in place of the first and second zippers.

Although the bunting bag of the present invention has been described and illustrated with reference to a preferred embodiment which is particularly well suited for use with children and child seats, it is of course understood that the bunting bag of the present invention may be easily configured for various other persons and seats. For example, the bunting bag may be sized for use with larger children or adults. The bottom and top portions may be shaped or configured for use with particular types of seats, including wheel chairs or arm chairs. In addition, it is understood that the bunting bag need not be used with a child carrier or other seat, but may be used separate from the carrier or seat, such as to hold the child.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A bunting bag for use with a seat having restraining straps, the bunting bag comprising:

(a) a shaped and flexible bottom portion sized and configured for a contoured fit with the seat;

(b) a separate and flexible top portion solely, detachably coupled to and selectively covering at least a portion of said bottom portion;

(c) a plurality of openings formed in the bottom portion, said plurality of openings sized and located to removably receive the restraining straps of the seat; and (d) fastening means disposed about a portion of a periphery of said top and said bottom portions for and variably detachably coupling said top portion to said bottom portion.

2. The bunting bag of claim 1, wherein the bottom portion comprises a back portion, a head portion extending from the back portion, a seat portion extending at an inclined angle from the back portion, a leg portion extending from the seat portion, a left side portion and a right side portion each extending between the back and seat portions and extending upwardly, and a soft inner surface; and wherein the top portion covers at least the leg, seat, and back portions of the bottom portion and comprises a body portion and a leg portion, the body portion being foldable over the leg portion.

3. The bunting bag of claim 2, wherein the fastening means comprises a first two-way zipper coupling at least a portion of the left side of the top and bottom portions, and a second two-way zipper coupling at least a portion of the right side of the top and bottom portions.

4. The bunting bag of claim 3, wherein either or both of the first or second zippers couples at least a portion of the bottom end of the top and bottom portions.

5. The bunting bag of claim 1, wherein the top portion further comprises a head portion, and wherein the top portion substantially covers the bottom portion.

6. A bunting bag as in claim 1, wherein said fastening means selectively couples or opens a left side, a right side and a bottom end of said top and bottom portions such that any of said left side, right side and bottom end may be coupled while the others remain open such that said top portion may be folded down or up or laterally for access.

7. The bunting bag of claim 1, further comprising a plurality of openings formed in the top portion, the plurality of openings sized and located for receiving hands or arms.

8. A system adapted for use with a person comprising:

(a) a seat having restraining straps; and (b) a bunting bag comprising:

(i) a shaped and flexible bottom portion adapted for substantially mating with said seat, said bottom portion comprising:

(A) a back portion, a head portion extending from said back portion, a seat portion extending at an inclined angle from said back portion, a leg portion extending from said bottom portion, a left side and a right side each extending between said back and said seat portions and extending upwardly, said back, head, seat, leg, left side and right side portions forming a containment area for holding the person;

(B) a soft inner surface adapted for being disposed adjacent the person; and (C) an outer surface for being disposed adjacent the seat;

(ii) a plurality of openings formed in said bottom portion, said plurality of openings sized and located to removably receive the restraining straps;

(iii) a separate and flexible top portion solely, detachably coupled to and substantially covering at least said leg, seat, and back portions of said bottom portion, said top portion comprising:

(A) a body portion adapted for covering a torso of the person and a leg portion adapted for covering the legs of the person, said body portion being foldable over said leg portion for exposing the body of the person; and (B) a soft inner surface adapted for being disposed adjacent the person; and (iv) fastening means for detachably and variably coupling said top portion to said bottom portion, said fastening means disposed about a portion of a periphery of said top and said bottom portions, said fastening means selectively and variably coupling or opening a left side, a right side, and a bottom end of said top and bottom portions to selectively and variably open any of said left side, right side, and bottom end while the others remain closed such that said top portion may be folded down or up for access to the person.

9. The system of claim 8, wherein said fastening means comprises a first two-way zipper coupling at least a portion of said left side of said top and bottom portions, and a second two-way zipper coupling at least a portion of said right side of said top and bottom portions.

10. The system of claim 9, wherein either or both of said first or second zippers couples at least a portion of said bottom end of said top and bottom portions.

11. The system of claim 8, wherein said top portion further comprises a head portion, and wherein said top portion substantially covers said bottom portion.

12. The system of claim 8, further comprising a plurality of openings formed in said top portion, said plurality of openings sized and located for receiving hands or arms.

13. A system adapted for use with a child comprising:

(a) a seat having restraining straps; and (b) a bunting bag comprising:

(i) a shaped and flexible bottom portion adapted for nesting within the seat between the seat and the child without substantial bunching or folding, said bottom portion having a surface area sized and configured for being substantially laterally contained within the seat to prevent said bottom portion from laterally protruding and interfering with the seat or its operation, said bottom portion comprising:

(A) a back portion, a head portion extending from said back portion, a seat portion extending at an inclined angle from said back portion, a leg portion extending from said seat portion, a left side portion and a right side portion each extending between said back and said seat portions and extending upwardly, said leg portion having a substantially wide area to provide sufficient leg movement for the child, said back, head, seat, leg, left side and right side portions forming a containment area for holding the child;

(B) a soft inner surface adapted for being disposed adjacent the child;

(C) an outer surface adapted for being disposed adjacent said seat; and (D) a plurality of holes extending through said bottom portion and adapted for receiving restraining straps of said seat;

(ii) a separate and flexible top portion solely, detachably coupled to and substantially covering said bottom portion, said top portion having a surface area sized and configured for being substantially laterally contained within the seat to prevent said top portion from laterally protruding and interfering with the seat or its operation, said surface area of said top portion being less than said surface area of said bottom portion, said top portion comprising:

(A) a head portion, a body portion, and a leg portion, the head portion being foldable over said body portion to expose the head of the child, said head and body portions being foldable over said leg portion to expose the head and body of the child, and said leg portion being foldable over said body portion to expose the legs of the child; and (B) a soft inner surface adapted for being disposed adjacent the child; and (iii) fastening means disposed about a portion of a periphery of said top and bottom portions for detachably and variably coupling said top portion to said bottom portion, said fastening means selectively and variably coupling or opening a left side, a right side, and a bottom end of said top and bottom portions to selectively and variably open any of said left side, right side, and bottom end while the others remain closed such that said top portion may be folded down or up for access to the child.

14. The system of claim 13, wherein said fastening means comprises a first two-way zipper coupling at least a portion of said left side of said top and bottom portions, and a second two-way zipper coupling at least a portion of said right side of said top and bottom portions.

15. The system of claim 14, wherein either or both of said first or second zippers couples at least a portion of said bottom end of said top and bottom portions.

16. A bunting bag adapted for use with a child and a seat, the bunting bag comprising:

(a) a shaped and flexible bottom portion sized and configured for a contoured fit between the child and the seat without substantial bunching or folding and having a surface area;

(b) a plurality of openings formed in said bottom portion;

(c) a separate and flexible top portion solely, detachably coupled to and selectively covering at least a portion of said bottom portion and having a surface area less than said surface area of the bottom portion; and (d) fastening means disposed about a portion of a periphery of said top and bottom portions for detachably and variably coupling said top portion to said bottom portion, said fastening means selectively coupling or opening a left side and a right side of said top and bottom portions to selectively open said left side or said right side while the other side remains closed such that said top portion may be folded to the side.

17. The bunting bag of claim 16 wherein said bottom portion has a surface area sized and configured for being substantially laterally contained within the seat to prevent said bottom portion from laterally protruding and interfering with the seat or its operation; and wherein said top portion has a surface area sized and configured for being substantially laterally contained within the seat to prevent said top portion from laterally protruding and interfering with the seat or its operation.

18. The bunting bag of claim 16, wherein said fastening means comprises a first zipper coupling at least a portion of said left side and a portion of said bottom end of said top and bottom portions, and a second zipper coupling at least a portion of said right side and a portion of said bottom end of said top and bottom portions.

19. A bunting bag for use with a person and a seat comprising:

(a) a shaped and flexible bottom portion adapted for nesting within the seat between the seat and the person, said bottom portion having a surface area sized and configured for being substantially laterally contained within the seat to prevent said bottom portion from laterally protruding and interfering with the seat or its operation;

(b) a separate and flexible top portion solely, detachably coupled to said bottom portion, said top portion having a surface area sized and configured for being substantially laterally contained within the seat to prevent said top portion from laterally protruding and interfering with the seat or its operation; and (c) fastening means disposed about a portion of a periphery of the top and bottom portions for detachably and variably coupling the top portion to the bottom portion, the fastening means selectively and variably coupling or opening a left side, a right side, and a bottom end of the top and bottom portion to selectively open any of the left side, right side and bottom end while the others remain closed such that the top portion may be folded down or up for access to the person.

20. A bunting bag as in claim 19 wherein the bottom portion further comprises:

(a) a back portion;

(b) a head portion extending from said back portion;

(c) a seat portion extending at an inclined angle from said back portion;

(d) a leg portion extending from said seat portion, said leg portion having a substantially wide area to provide sufficient leg movement for the person,;

(e) a left side portion and a right side portion each extending between said back and seat portions, said left side and right side portions extending upwardly, wherein said back, head, seat, leg, left side and right side portions form a containment area for holding the person;

(f) a soft inner surface adapted for being disposed adjacent the seat; and (g) a plurality of holes extending through the bottom portion and adapted for receiving restraining straps of the seat.

21. A bunting bag as in claim 19 wherein said bottom portion nests within the seat between the seat and the person without substantial bunching or folding.

22. A bunting bag as in claim 19 wherein said top portion further comprises:

(a) a leg portion;

(b) a body portion and a head portion, said head portion being foldable over the body portion, said body and head portions being foldable over said leg portion such that the head of the person is exposed, said leg portion being foldable over said body portion such that the legs of the person are exposed; and (c) a soft inner surface adapted for being disposed adjacent the person.

23. A bunting bag as in claim 19 wherein said surface area of said top portion is less than said surface area of said bottom portion.

24. A child bunting bag adapted for use with a child and/or a seat, the bunting bag comprising:

(a) a shaped and flexible bottom portion sized and configured for a contoured fit between the child and the seat without substantial bunching or folding and having a surface area;

(b) a support strap connected to the bottom portion capable of encompassing the seat and providing support to said bottom portion;

(c) a separate and flexible top portion solely, detachably coupled to and selectively covering at least a portion of said bottom portion and having a surface area less than said surface area of said bottom portion; and (d) fastening means disposed about a portion of a periphery of said top and bottom portions for detachably and variably coupling said top portion to said bottom portion, said fastening means selectively and variably coupling or opening a left side and a right side of said top and bottom portions to selectively and variably open said left side or right side while the opposite side remains closed such that said top portion may be folded to the side.

25. A bunting bag comprising:

(a) a shaped and flexible bottom portion sized and configured for a contoured fit with a seat without substantial bunching or folding and having a surface area;

(b) a separate and flexible top portion solely, detachably coupled to and selectively covering at least a portion of said bottom portion and having a surface area less than said surface area of said bottom portion;

(c) a plurality of openings formed in said bottom portion; and (d) fastening means disposed about a portion of a periphery of said top and bottom portions for detachably coupling said top portion to said bottom portion, said fastening means selectively coupling or opening a left side, a right side, and a bottom end of said top and bottom portions to selectively open any of said left side, right side, and bottom end while the others remain closed such that said top portion may be folded down or up or laterally for access.

26. A bunting bag comprising:

(a) a shaped and flexible bottom portion sized and configured for a contoured fit with a seat without substantial bunching or folding and having a surface area;

(b) a separate and flexible top portion, wherein a part of said top portion is permanently connected to said bottom portion and part of said top portion is solely, detachably coupled to at least a portion of said bottom portion;

(c) a plurality of openings formed in said bottom portion; and (d) fastening means disposed about a portion of a periphery of said top and bottom portions for detachably coupling said top portion to said bottom portion, said fastening means selectively coupling or opening a left side, a right side, and a bottom end of said top and bottom portions to selectively open any of said left side, right side, and bottom end while the others remain closed such that said top portion may be folded down or up or laterally for access.

* * * * *